US006888310B2

(12) United States Patent
Tadaki et al.

(10) Patent No.: US 6,888,310 B2
(45) Date of Patent: May 3, 2005

(54) PLASMA DISPLAY PANEL WITH DIELECTRIC LAYER CONTAINING A FILLER OF MICA COATED WITH TITANIUM DIOXIDE

(75) Inventors: Shinji Tadaki, Kawasaki (JP); Noriyuki Awaji, Kawasaki (JP); Fumihiro Namiki, Kawasaki (JP); Katsuya Irie, Kawasaki (JP); Hideki Harada, Satsuma (JP); Tadayoshi Kosaka, Kawasaki (JP)

(73) Assignee: Fujitsu Limited, Kawasaki (JP)

( * ) Notice: Subject to any disclaimer, the term of this patent is extended or adjusted under 35 U.S.C. 154(b) by 149 days.

(21) Appl. No.: 09/818,499

(22) Filed: Mar. 28, 2001

(65) Prior Publication Data

US 2001/0054871 A1 Dec. 27, 2001

Related U.S. Application Data

(63) Continuation of application No. PCT/JP99/05288, filed on Sep. 27, 1999.

(30) Foreign Application Priority Data

Sep. 29, 1998 (JP) ..... 10-274649

(51) Int. Cl.[7] ..... H01J 17/49
(52) U.S. Cl. ..... 313/586; 313/587; 313/582
(58) Field of Search ..... 313/484–492, 313/582–587

(56) References Cited

U.S. PATENT DOCUMENTS 5,264,758 A * 11/1993 Iijima et al. ..... 313/584
5,436,084 A * 7/1995 Haluska et al. ..... 428/688
5,464,726 A * 11/1995 Gelorme et al. ..... 430/326
5,605,781 A * 2/1997 Gelorme et al. ..... 430/280.1
6,184,621 B1 * 2/2001 Horiuchi et al. ..... 313/586

FOREIGN PATENT DOCUMENTS

| | | |
|---|---|---|
| JP | 4-47639 | 2/1992 |
| JP | 4-180921 A | 6/1992 |
| JP | 4-191727 A | 7/1992 |
| JP | 05-047305 | 2/1993 |
| JP | 06-011613 | 1/1994 |
| JP | 07-045200 | 2/1995 |
| JP | 09-045237 | 2/1997 |
| JP | 09-071403 | 3/1997 |
| JP | 9-213215 | 8/1997 |
| JP | 9-231910 | 9/1997 |
| JP | 10-206615 A | 8/1998 |
| JP | 11-054051 | 2/1999 |
| JP | 11-144625 | 5/1999 |
| JP | 11-250809 | 9/1999 |

OTHER PUBLICATIONS

ASI Instruments Inc. TM, "Dielectric Constant Reference Guide", retrieved from the WWW Oct. 24, 2003, from url:http://www.asiinstr.com/dc1.html.*
Decision of Rejection; Application No.: 2000–572889; Applicant: Fujitsu Limited; Dated: Jun. 29, 2004.
Dismissal Of Amendment; Application No.: 2000–572889; Applicant: Fujitsu; Dated: Jun. 29, 2004.

* cited by examiner

*Primary Examiner*—Vip Patel
*Assistant Examiner*—Anthony T. Perry
(74) *Attorney, Agent, or Firm*—Staas & Halsey LLP

(57) ABSTRACT

A plasma display panel includes a dielectric layer in which a filler for enhancing reflectance is dispersed. To increase luminescence efficiency, the filler consists of flakes oriented in parallel to the surface of the dielectric layer.

12 Claims, 5 Drawing Sheets

PLASMA DISPLAY PANEL WITH DIELECTRIC LAYER CONTAINING A FILLER OF MICA COATED WITH TITANIUM DIOXIDE

This application is a continuing application, filed under 35 U.S.C. §111(a), of International Application PCT/JP99/05288, filed Sep. 27, 1999, it being further noted that priority is based upon Japanese Patent Application HEI 10-274649, filed Sep. 29, 1984.

TECHNICAL FIELD

The present invention relates to a PDP (plasma display panel) having a dielectric layer in which a filler for enhancing display luminance is dispersed, its substrate structure and a process for manufacturing the substrate structure.

BACKGROUND ART

PDPs have been becoming widespread as large-screen display devices for television and computer output since color display was practically realized on the PDPs. Now the market demands larger screen devices with higher definition.

Among the PDPs, surface discharge-type AC-driven PDPs are commercialized. The surface discharge type is a type in which first and second main electrodes which act alternately as positive electrodes and negative electrodes in AC driving utilizing wall charges for sustaining a lighting state are arranged in parallel in one of a pair of substrates. Since the main electrodes extend in the same direction, third electrodes crossing the main electrodes are required for selecting cells. The third electrodes are placed on the other one of the pair of substrates to be opposed to the main electrodes with intervention of a discharge gas space in order that electrostatic capacity of the cells is reduced. When a picture is displayed, addressing is carried out for controlling wall charges according to the contents to be displayed, by generating address discharge across one of each main electrode pair (e.g., the second electrode) and the third electrode. After addressing is performed line by line, for example, alternating voltage for sustaining lighting is applied to the main electrode pairs at a common timing to all rows to generate surface discharge along the surface of the substrate only in cells having wall charges. When the cycle of applying the voltage is shortened, it is possible to obtain a seemingly continuous lighting state.

In a surface discharge-type PDP, it is possible to suppress deterioration of fluorescent layers for color display owing to ion impact during discharge and extend the life of the PDP by providing the fluorescent layers on the other substrate opposed to the substrate on which the main electrode pairs are disposed. PDPs having the fluorescent layers on their rear substrates are referred to as "reflection type PDPs" and PDPs having the fluorescent layers on their front substrates are referred to as "transmission type PDPs." The reflection type PDPs, in which light is emitted from front side surfaces of the fluorescent layers, are superior in luminous efficiency.

In a commercialized reflection type PDP, address electrodes are placed as the third electrodes on the rear substrate. The address electrodes are covered with a dielectric layer, on which barrier ribs are formed to partition a discharge space by the column. The fluorescent layers are provided to cover sidewalls of the barrier ribs and exposed faces of the dielectric layer. The formation of the barrier ribs only on one substrate facilitates alignment in assembly of the pair of substrates. The provision of the fluorescent layers even in the sidewalls of the barrier ribs enlarges a light-emitting area and widens a viewing angle. The dielectric layer functions as a dielectric for providing electrical characteristics suitable for driving. In addition, in the case where the barrier ribs are formed by sandblasting, the dielectric layer is used as a cutting-resistant layer to prevent over-cutting in a depth direction and protect the address electrodes.

Conventionally, a PbO— or ZnO-containing low-melting-point glass, the thermal expansion coefficient of which is only a little different from that of the substrate, is used as a material for the dielectric layer covering the address electrodes. This low-melting-point glass as a base is mixed with a filler having a refractive index greatly different from that of the base, such as titanium dioxide ($TiO_2$: titania), for the purpose of whitening the dielectric layer. The dielectric layer, if whitened, can reflect light that is emitted from the fluorescent layers and travels toward the rear substrate, to the front substrate, thereby enhancing the luminance. A white dielectric layer has a larger reflectance with regard to visible light than a transparent one.

With conventional PDPs, there is a problem in that a large amount of electric power is consumed wastefully in charging and discharging of a floating capacity between address electrodes. As the size of cells is reduced for higher definition, the floating capacity becomes larger. Consequently reactive power increases and also the waveform of a driving pulse turns dull, which result in a remarkable delay in response during driving. As the number of pixels is increased, more power is required for addressing. Therefore, the floating capacity has more serious effect from the viewpoint of heat generation. For example, as compared with a VGA specification (640×480 pixels) for NTSC television system, a SXGA specification (1280×1024 pixels) has more than twice as many rows and twice as many columns as the VGA specification. Accordingly, in order to ensure a normal frame rate, the frequency of a pulse applied to the address electrodes must be doubled at least. In addition to that, the number of address electrodes is doubled. Consequently, addressing requires four times more electric power.

There is another problem in that specific sites on an inside face cannot be sufficiently whitened for enhancing the luminous efficiency. That is, if the content of the filler for whitening is increased as a first technique, the dielectric constant of the dielectric layer increases and more power is consumed. That is because the relative dielectric constant of the filler (e.g., 80 to 110 for titania) is extremely larger than that of the lower-melting glass base (10 to 14). If the dielectric layer is thickened as a second technique, the lower limit of drive voltage in addressing rises. Also in order to ensure a discharge space having a desired volume, the thickness of the dielectric layer provided as a reflective layer is required to be as small as possible.

An object of the present invention is to increase the luminous efficiency. Another object of the present invention is to provide a plasma display panel having a dielectric layer whose relative dielectric constant is small and whose reflectance is large.

DISCLOSURE OF INVENTION

The present invention is a plasma display panel comprising electrodes arranged on a substrate on a rear side; a dielectric layer provided to cover the electrodes; and a fluorescent layer formed on a front side of the dielectric layer, wherein the dielectric layer is formed of a mixture of a base material and a filler having a smaller relative dielectric constant than the base material and the dielectric layer has a smaller relative dielectric constant and a larger reflectance than a layer formed of the base material but not containing the filler.

In another aspect, the present invention is a plasma display panel having a dielectric layer in which a filler for enhancing reflectance is dispersed, wherein the filler comprises pieces individually having outward appearance of flakes whose front and back faces are oriented in a direction along a surface of the dielectric layer.

BEST MODE FOR CARRYING OUT THE INVENTION

In the present specification, the dielectric layer may be rephrased as an insulator layer. These two terms have exactly the same meaning.

In the present invention, in order to reduce power consumption by the floating capacity between electrodes, a mixture of a base material and a filler having a relative dielectric constant smaller than that of the base material or a mixture of a base material having a low dielectric constant and a filler is used as a material for the dielectric layer covering the electrodes arranged on a substrate on a rear side of a discharge space. Preferably difference between the refractive indices of the base material and the filler is as large as possible. The larger the difference between the refractive indices, the larger the reflectance of the dielectric layer and the higher the luminance. In the case where a base material of high dielectric constant is used, the mixing of the filler decreases the relative dielectric constant of the dielectric layer as compared with the case where the filler is not mixed, and consequently the floating capacity decreases.

In the present invention, the base material means a material which melts when burned and solidifies thereafter to form a main constituent element of the dielectric layer, or a material which solidifies when burned to form a main constituent element of the dielectric layer. As raw materials for forming this base material, can be used powder of low-melting-point glass frit, colloidal silica obtained, for example, from siloxane oligomer and silica sol, and the like. The colloidal silica turns into silicon oxide (silica) through burning.

The filler means a material which remains as it is without melting or disappearing after the dielectric layer is burned, that is, an inorganic material having a higher melting point than that of the raw material for the base material. In the case of a base material of high dielectric constant such as a PbO-containing low-melting-point glass, it is sufficient that the filler has a smaller relative dielectric constant than that the base material, and mica, silica powder, alumina powder, soda glass powder, borosilicate glass powder and the like may be used.

The form of the filler is not limited to an ordinary powdery form, but may be a flake form such as of the above-mentioned mica or mica coated with titanium dioxide (titania-coated mica). In addition, the filler may have hollows.

From the viewpoint of enhancing the reflectance, it is desirable that titania-coated mica should be used as the filler.

Figure 1:
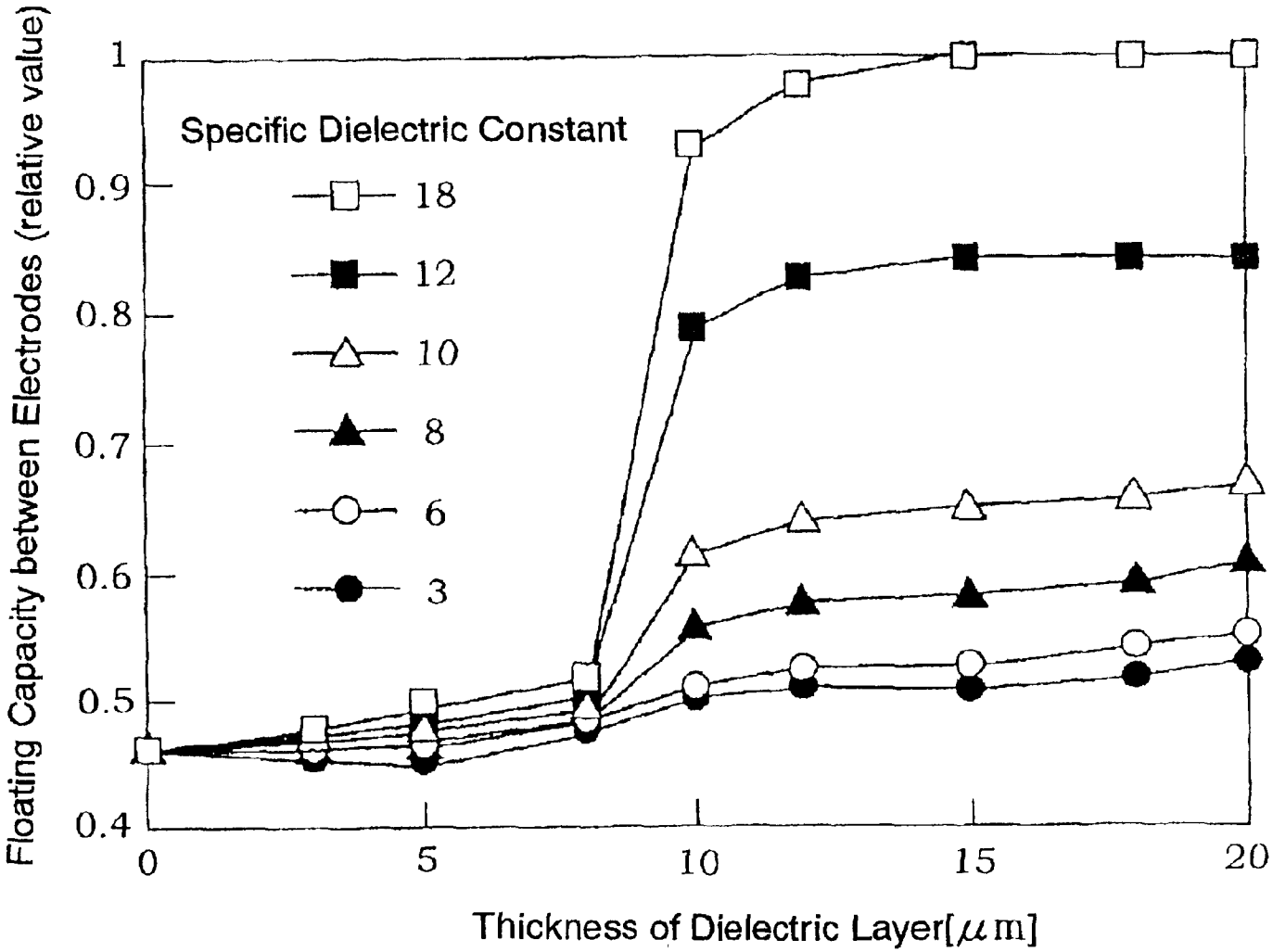
FIG. 1 is a graph representing a relationship among the thickness of a dielectric layer, its relative dielectric constant, and floating capacity between electrodes.

FIG. 1 is a graph representing a relationship among the thickness of the dielectric layer, its relative dielectric constant, and the floating capacity between electrodes, based on measurement of PDPs actually produced for trial with varying parameters. It is noted that the dielectric constant of conventional typical dielectric layers is about 12 to 18.

The smaller the relative dielectric constant of the dielectric layer, the smaller the floating capacity. Particularly, the floating capacity decreases greatly between a relative dielectric constant of 12 and a relative dielectric constant of 10. Even if the relative dielectric constant is smaller six, which is of the same degree as the substrate, the floating capacity does not decrease so much.

On the other hand, the thinner the dielectric layer, the smaller the floating capacity. It should be particularly remarked that the floating capacity decreases sharply between a thickness of 10 $\mu$m and a thickness of 8 $\mu$m and that, where the thickness is 8 $\mu$m or less, the floating capacity changes little with changes of the thickness regardless of the relative dielectric constant.

Accordingly, in order to reduce the floating capacity more than the conventional floating capacity, it is effective ① to reduce the relative dielectric constant to 10 or less and ② to thin the dielectric layer (preferably, to 8 $\mu$m or less). However, the lower limits of the relative dielectric constant and the thickness are the minimum values at which required functions are able to be obtained. For example, in the case where a titania-coated flake-form mica of 15 $\mu$m or less×0.5 $\mu$m or less in size is used as the filler, the lower limit of the thickness of the dielectric layer is a value close to 0.5 $\mu$m. As to the relative dielectric constant, for example, in the case where hollow glass micro-balloons are used as the filler, the lower limit of the relative dielectric constant is a value close to 1 (i.e., dielectric constant value in vacuum) because it can be brought close to 1 by enlarging hollows. If the relative dielectric constant is 6 or less or the thickness is 8 $\mu$m or less, the floating capacity is affected little even if an actual value of the relative dielectric constant is different from a designed value owing to a variation in the composition of the material or even if the thickness varies owing to a variation in a film formation process, and therefore, stable display characteristics can be obtained.

It is also effective for reducing the floating capacity to form thin electrodes by a thin film formation technique such as sputtering, evaporation or the like. Although the floating capacity can be reduced by decreasing the width of the electrodes, it is difficult to obtain sufficient effect because that will decline the probability of discharge.

In the present invention, in order to enhance the luminance while avoiding an increase in the relative dielectric constant which would affect driving, the filler to enhance the reflectance is preferably composed of small pieces individually having a flake-form outward appearance which are so oriented that main surfaces of flakes function as reflective faces. By coating a supporting face with a paste or a fluid such as a suspension which has a proper viscosity and in which the filler is dispersed, the filler is oriented in a direction along the surface of a coated layer by coating pressure and by surface tension of the coating layer. By attaching a sheet having been formed beforehand by coating a flat surface with the fluid, a reflective layer having the filler oriented in a suitable direction can be easily formed also on the sidewalls of the barrier ribs. In the case of coating, as a coated surface approaches the vertical, gravity has more effect and the action of surface tension weakens, so that it becomes difficult to obtain a desired orientation. A practical range for the content of the filler is 10 wt % to 80 wt % of a dielectric since the filler does not execute effect if its content is too small and it makes difficult the formation of the dielectric layer if its content is too large. In the case of using a filler whose surface is formed of titania such as titania-coated mica, for example, it is preferable to fuse titania or disperse titania in a particulate form in a dispersing medium in addition to the flake-form filler, in order to suppress a decrease in the reflectance owing to diffusion of titania in the dispersing medium during the burning of the coated layer. If titania is particulate, preferably its particle diameter is sufficiently small relative to the thickness of the dielectric layer. That allows larger process margins since a fall in the reflectance through burning is decreased and thereby a smaller change is caused by a variation in the burning temperature.

The dielectric layer may be formed by applying onto a supporting face a low-melting-point glass paste mixed with particulate titanium dioxide and flake-form mica coated with titanium dioxide, followed by burning. In this case, the mixture ratio of the particulate titanium dioxide to the flake-form mica is desirably within the range of 5 wt % to 30 wt %, and the particle diameter of the particulate titanium dioxide is desirably 5 $\mu$m or less.

The dielectric layer may also be formed by applying onto a substrate a colloidal silica mixed with the flake-form filler, followed by burning.

Also the dielectric layer may be formed by attaching (laminating) to a supporting face a dielectric sheet in which the flake-form filler is dispersed in a state of uniform orientation.

Further, the dielectric layer may also be formed by attaching and setting to a hollow form a dielectric sheet in which the flake-form filler is dispersed in a state of uniform orientation, and then transferring the dielectric sheet to a substrate.

In the present specification, the substrate structure means a structure including a plate-shape supporting member having a size larger than or equal to a display area and at least one other constituent element. In other words, in a production process of sequentially forming a plurality of constituent elements on a substrate as the supporting member, the substrate structure represents work in process including the substrate as a main constituent in every step after a first constituent element is formed on the substrate.

Figure 2:
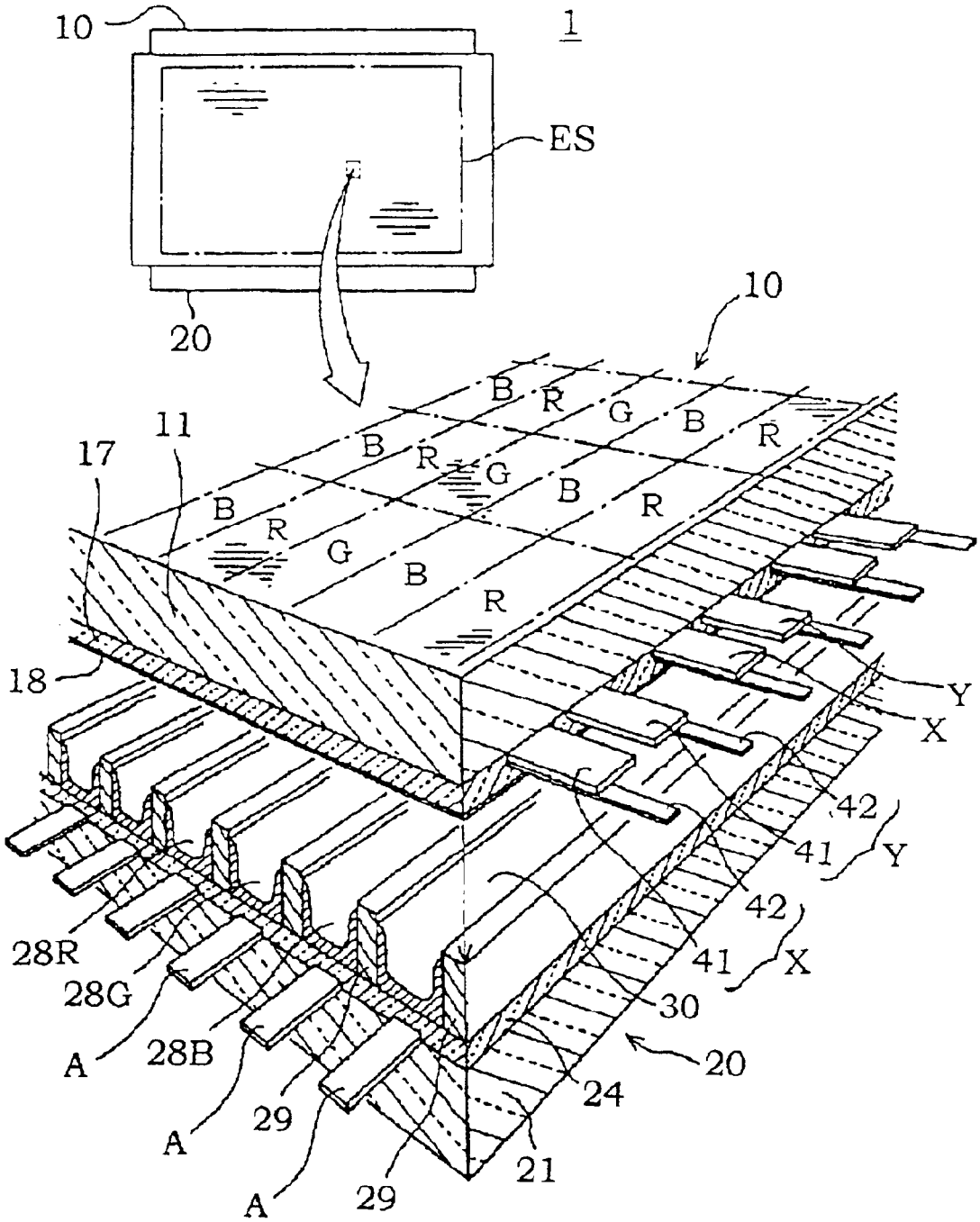
FIG. 2 is an exploded perspective view illustrating the internal basic structure of a PDP in accordance with the present invention.

FIG. 2 is an exploded perspective view illustrating the internal basic structure of a PDP 1 in accordance with the present invention.

The PDP 1 shown as an example is an AC-driven color PDP of three-electrode surface discharge structure. In each of the cells (display elements) constituting a screen ES, a pair of main electrodes X and Y crosses an address electrode A. The main electrodes X and Y are arranged on an inner surface of a glass substrate 11 which is a base material of a substrate structure 10 on a front side and are each formed of a transparent electroconductive film 41 and a metal film 42. A PbO-containing low-melting-point glass layer of about 30 $\mu$m to 50 $\mu$m thickness is provided as a dielectric layer 17 to cover the main electrodes X and Y. A MgO film is formed as a protective film 18 on a surface of the dielectric layer 17.

The address electrodes A are arranged on an inner surface of a glass substrate 21 which is a base material of the substrate structure 10 on a rear side and are covered with a dielectric layer 24 specific to the present invention. The thickness of the address electrodes A is about 1 $\mu$m to 2 $\mu$m. Barrier ribs 29 rectilinear as seen in a plan view are arranged at equal intervals on the dielectric layer 24. The barrier ribs 19 partition a discharge space 30 for every cell in a direction of rows (in a horizontal direction on the screen). A discharge gas is a Penning gas containing neon and a small amount of xenon.

Fluorescent layers 28R, 28G and 28B of three colors R, G and B for color display are provided to cover the inner surface of the substrate on the rear side including surfaces above the address electrodes and sidewalls of the barrier ribs 29. One pixel for display is composed of three sub-pixels aligned in the row direction (in the horizontal direction on the screen). Sub-pixels aligned in a direction of columns (in a vertical direction on the screen) emit light of the same color. A structural unit in each sub-pixel is a cell. Since the barrier ribs are arranged in a stripe pattern, a part of the discharge gas space 30 corresponding to each column is continuous in the column direction, bridging all the rows.

In PDP 1, the address electrodes A and the main electrodes Y are used for selecting (addressing) the lighting (light emission)/non-lighting of the cells. More particularly, screen scanning is performed by sequentially applying a scan pulse to n main electrodes Y (n is the number of rows) one by one. Address electrodes A are selected according to the content to be displayed. An opposite face discharge (address discharge) generated across the main electrodes Y and the selected address electrodes forms a desired charged state row by row. After addressing, a sustain pulse of a predetermined wave height is applied alternately to the main electrodes X and Y to generate surface discharge along the substrate in cells having a suitable amount of wall charge present at the end of addressing. The fluorescent layers 28R, 28G and 28B are locally excited by ultraviolet emitted by the discharge gas when surface discharge takes place. Of visible light emitted by the fluorescent layer 28R, 28G and 28B, light passing through the glass substrate 11 contributes to display.

The PDP 1 of the above-described construction is completed through the step of providing desired constituent elements separately on the glass substrates 11 and 21 to produce the substrate structure 10 on the front side and the substrate structure 20 on the rear side, the (assembly) step of putting the substrate structures 10 and 20 together and sealing the periphery of a gap therebetween and the step of cleaning the inside and feeding the discharge gas. A gas tube provided on the glass substrate 21 on the rear side is used for gas exhaustion and gas feeding. When the substrate structure 20 on the rear side is fabricated, the dielectric layer 24 is formed using a glass paste in which a PbO-containing low-melting-point glass base material is mixed with the filler for reducing the relative dielectric constant and enhancing the reflectance and a vehicle, a glass sheet formed by dispersing a low-melting-point glass base and the filler in a binder, or a colloidal suspension mixed with the filler.

For reducing the relative dielectric constant, there is a technique of selecting the mixture ratio of a lead component in the glass base. However, since other properties such as melting point and thermal expansion coefficient are changed through this technique, the range of relative dielectric constant capable of being practically set is as small as about 10 to 15. On the other hand, for enhancing the reflectance, if an ordinary titanium dioxide ($TiO_2$) powder is mixed, the relative dielectric constant of the dielectric layer 24 is larger than that of the glass base because the relative dielectric constant of titanium dioxide is 80 or more. For example, if the glass base has a relative dielectric constant of 12, the dielectric layer 24 has a relative dielectric constant of about 18.

Therefore, when the present invention is applied for forming the dielectric layer 24, and a white filler having a smaller relative dielectric constant than that of the glass base is used. Here white means that the surface area is large and the refractive index is different from that of the glass base. More particularly, alumina ($Al_2O_3$) and silica ($SiO_2$) are suitable as the filler. In particular, since silica has a small relative dielectric constant of 4.5, the relative dielectric constant of the dielectric layer 24 can be reduced to about 7 if silica powder is mixed at a ratio of about 20 wt % to the glass base. In the case of alumina, the relative dielectric constant of the dielectric layer 24 can be reduced to about 9 if alumina is mixed at a ratio of about 30 wt % to the glass base. It is noted that, although the relative dielectric constant can be further decreased by raising the mixture ratio of the filler, the filler mixed in a larger ratio increases the viscosity of the glass paste, which makes difficult the handling of the paste during printing and the like. The practical upper limit of the mixture ratio of the filler is about 70 wt %, though it depends on the surface state, specific gravity and particle diameter of the filler.

As mentioned above, other usable powdery fillers are glass materials such as soda glass, borosilicate glass and the like. In other words, usable are such materials that has a smaller relative dielectric constant than that of the glass base and a melting point equal to or higher than temperature at which the dielectric layer 24 is burned. The larger the difference between the refractive index of the filler and that of the glass base, the larger the reflectance of the dielectric layer 24.

The form of the filler is not limited to ordinary powder, but may be flakes like mica (its dielectric constant is 6 to 8) or may also be hollow. For example, hollow glass micro-balloons such as HSC-110 made by Toshiba Barotini Co., Ltd. may be used. The hollow glass micro-balloons are balloons of soda glass having an average particle diameter of about 10 $\mu$m. Since they are substantially a substance like a mass of air, they have a relative dielectric constant as small as about 2 and also a small refractive index. If such hollow glass micro-balloons are mixed at a ratio of about 10 wt % to the glass base, the relative dielectric constant of the dielectric layer 24 can be reduces to about 4 and furthermore the reflectance can be raised to about 70%.

Table 1 shows the refractive indices and relative dielectric constants of the glass substrate (soda lime glass), low-melting-point glass base ($PbO.SiO_2.B_2O_3.ZnO$) and the filler.

TABLE 1

| Material | Refractive Index | Specific Dielectric Constant |
|---|---|---|
| Soda lime (glass substrate) | About 1.5 | 6–8 |
| Low-melting-point glass (glass base material) | 1.5–1.7 | 10–14 |
| Titanium oxide | 2.7–3.2 | 80–110 |
| Silica | 1.5 | 3.8–4.5 |
| Alumina | 1.8 | 9.3–11.5 |
| Glass micro-balloon | About 1 | About 2 |

Figure 3A:
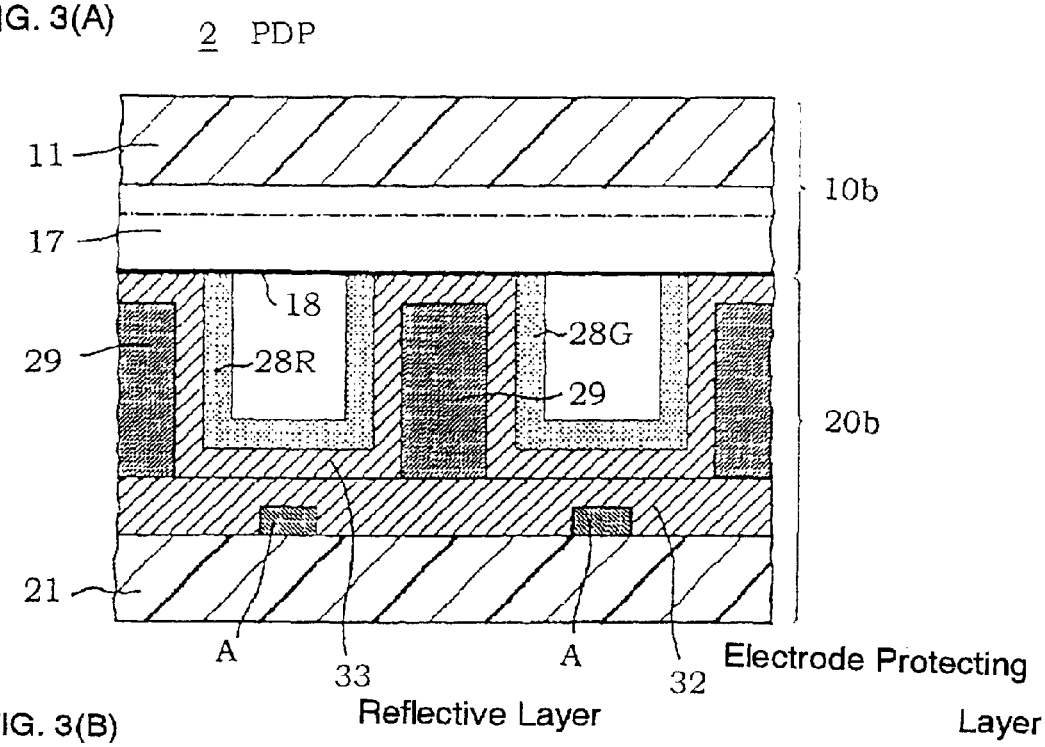
FIGS. 3(A) and 3(B) are schematic sectional views illustrating the construction of a major part of a PDP in accordance with a second embodiment of the present invention.
Figure 3B:
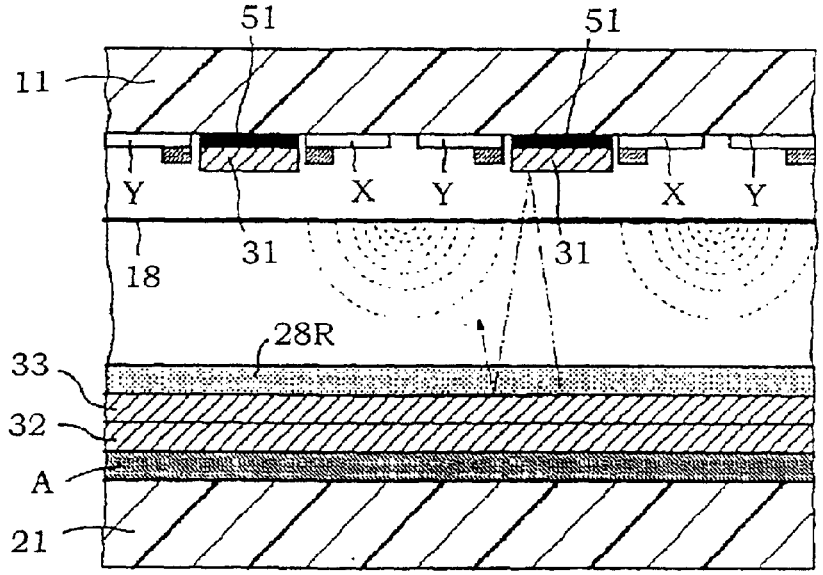

FIGS. 3(A) and 3(B) are schematic sectional views illustrating the construction of a major part of a PDP 2 in accordance with a second embodiment. In these figures, constituent elements having the same functions as those of PDP 1 shown in FIG. 2 are indicated by the same reference numbers as in FIG. 2. Since the basic construction of the PDP 2 is the same as that of the above-described PDP 1, only characteristic parts are described here.

A substrate structure 20*b* on the rear side of the PDP 2 has an electrode protecting layer 32 covering address electrodes A and a reflective layer 33 covering sidewalls of barrier ribs 29 as shown in FIG. 3(A). These electrode protecting layer 32 and reflective layer 33 are dielectric layers whitened for enhancing the luminance. Processes for producing the substrate structure 20*b* are roughly divided into two types. One is to form the address electrodes A, the electrode protecting layer 32, the barrier ribs 29, the reflective layer 33 and fluorescent layers 28R, 28G and 28B (28B is not shown) sequentially on a glass substrate 21. The other is to form the reflective layer 33 and the barrier ribs 29 using a hollow form provided with recesses in a pattern corresponding to that of the barrier ribs and transferring the reflective layer 33 and the barrier ribs 29 from the hollow form onto a glass substrate 21 on which the address electrodes A as well as the electrode protecting layer 32 have been separately formed. In the latter, the fluorescent layers 28R, 28G and 28B may be formed after transfer or may be formed on the hollow form before the reflective layer 33 is formed. For forming the electrode protecting layer 32 and the reflective layer 33, there are a method of applying materials for the layers to the glass substrate 21 or to a face (layer formation face) supported by the hollow form and a method of attaching (laminating) a resin sheet as described later.

As shown in FIG. 3(B), a light-shielding layer 51 forming so-called black stripes is provided in electrode gaps (referred to as reverse slits) between adjacent rows on an inner face of a glass substrate 11 on the front side. A reflective layer 31 is formed on the rear side of the light-shielding layer 51. The reflective layer 31 is also a whitened dielectric layer.

In the PDP 2, the whitening of the reflective layers 31 and 33 and the electrode protecting layer 32 is performed by dispersing a filler of pieces individually having a flake-form outward appearance. This whitening allows the content of the filler to be reduced for decreasing the relative dielectric constant of the layers while enhancing the reflectance.

Figure 4:
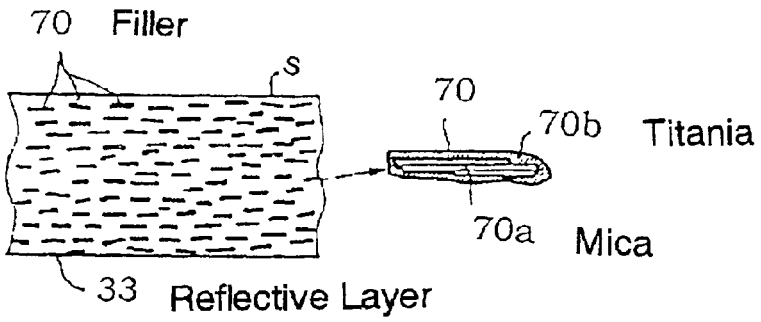
FIG. 4 is a schematic sectional view illustrating an orientation state of a filler.

FIG. 4 is a schematic sectional view illustrating an orientation state of the filler. Though the reflective layer 33 is shown as a typical example in the figure, the orientation states of the electrode protecting layer 32 and the reflective layer 31 are similar to that of the reflective layer 33.

In the reflective layer 33, a filler 70 is dispersed in a state such that front and back faces (end faces in a thickness direction) of each flake are oriented in a direction along a surface s of the reflective layer 33. Thereby, an effective reflective face increases and the reflectance improves, as compared with the case where the front and back faces are oriented along the thickness direction of the layer and the case where a particulate filler is dispersed. As the filler, suitable are pieces of mica 70*a* coated with titania 70*b* (referred to as titania-coated mica hereinafter).

Figure 5A:
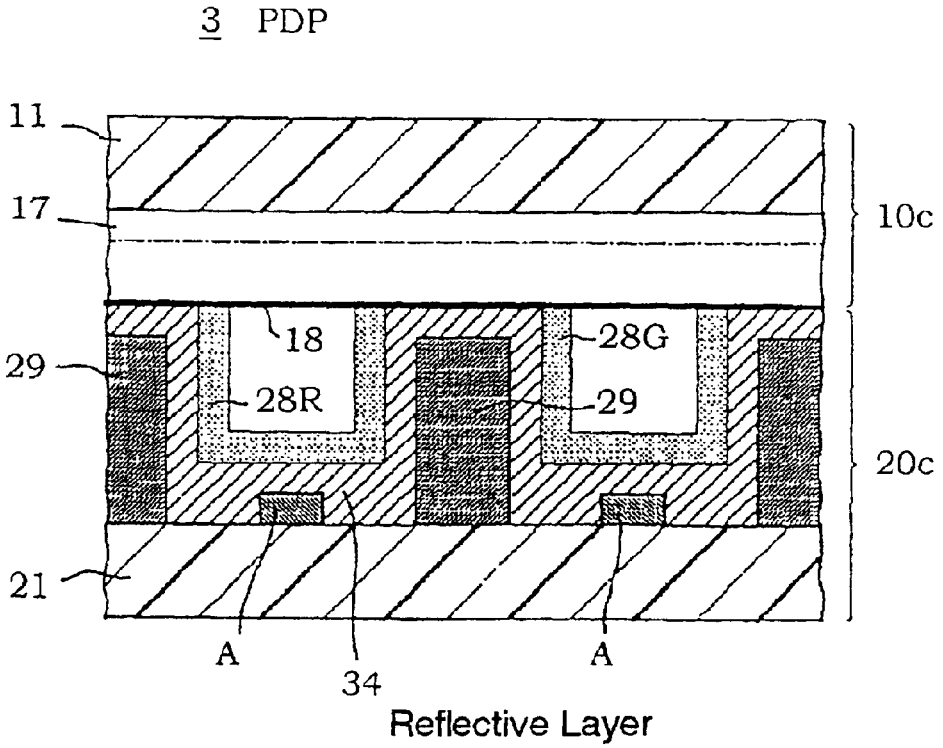
FIG. 5 is a schematic sectional view illustrating the construction of a major part of a PDP in accordance with a third embodiment of the present invention.

FIG. 5 is a schematic sectional view illustrating the construction of a major part of a PDP 3 in accordance with a third embodiment.

The PDP 3 is also composed of a pair of substrate structures 10*c* and 20*c* whose basic construction is the same as that of the above-described PDPs 1 and 2. In the PDP 3, a reflective layer 34 specific to the present invention is provided to cover address electrodes A and barrier ribs 29 on the substrate structure 20*c* on the rear side.

Figure 6A:
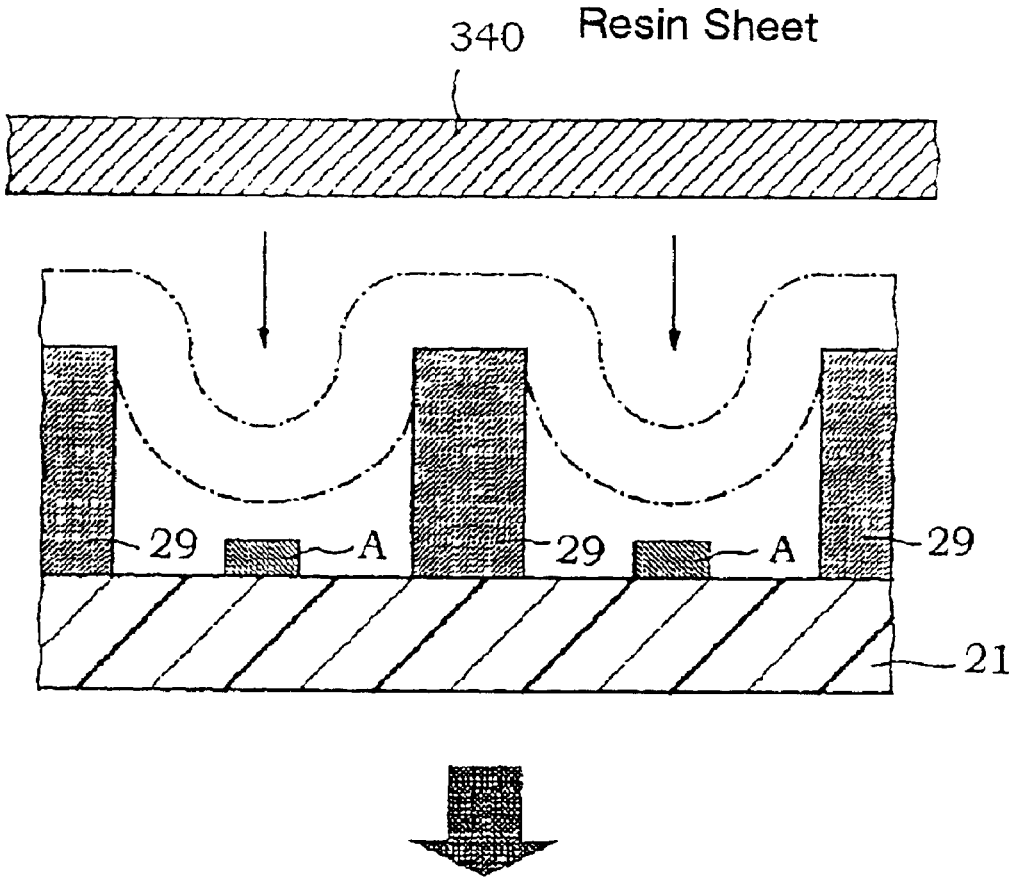
FIGS. 6(A) and 6(B) show an example of a process for forming a dielectric layer in accordance with the present invention.
Figure 6B:
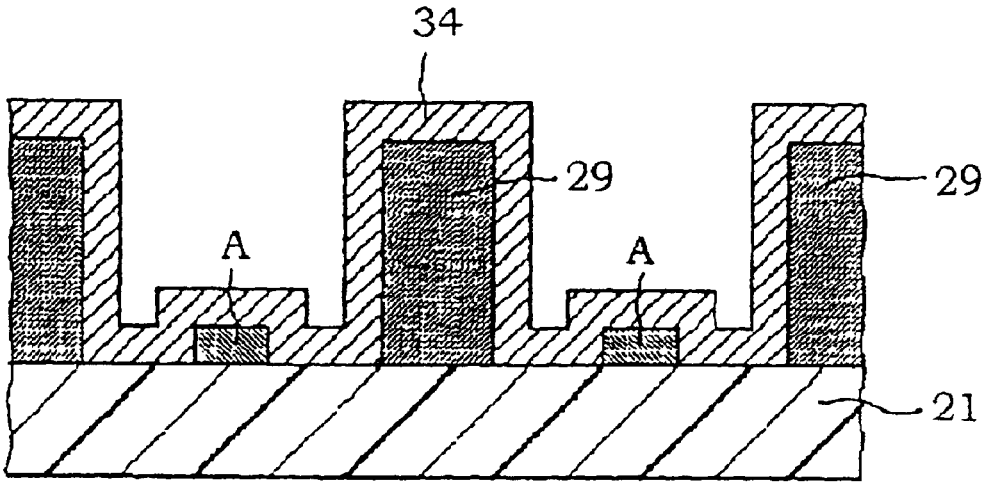

FIGS. 6(A) and 6(B) show an example of a process for forming a dielectric layer in accordance with the present invention.

Is formed in advance a resin sheet 340 in which a flake-form filler is uniformly oriented in the above-mentioned direction. The resin sheet 340 is placed on a glass substrate 21 on which address electrodes A and barrier ribs have already been formed. The resin sheet 340 is deformed and brought in close contact with a supporting face using one or a plurality of techniques of heating, pressurization and suction of air between the barrier ribs. After a resin component is burned away by burning, the reflective layer 34 is obtained. This process can be applied to the formation of the reflective layer 33 of the PDP 1 shown in FIG. 2.

Hereinafter, the reflective layers 31, 33 and 34 and the electrode protecting layer 32 are generally taken as dielectric layers specific to the present invention, and their materials and formation process are explained with reference to examples.

EXAMPLE 1

Mixed were a low-melting-point glass frit having an average particle diameter of about 3 μm (made by Central Glass Co., Ltd., a melting point: 510° C., Product number : BI6295) with a titania-coated mica of flake form whose size is 15 μm or less×0.5 μm or less (Iriodin 111, made by Merk KGaA (Merk Japan Ltd.)) in a ratio of 85:15 by weight. The resulting mixture was dispersed with use of a triple roll mill in a vehicle in which ethyl cellulose was dissolved in 5 wt % in a mixed solvent of terpineol and butyl carbitol acetate, to give a paste. As a comparative example, the above-mentioned low-melting-point glass frit and a titania powder were weighed in a ratio of 70:30 and dispersed in the same vehicle in the same manner as described above, to give a paste. These pastes were applied with use of a roll coater to transparent glass substrates and substrates on which electrodes had been formed beforehand, followed by drying and then burning, to form dielectric layers, which were each 10 μm thick. Results of measurement of their reflectance and relative dielectric constant are shown in Table 2.

TABLE 2

| | Refractive Index (550 nm) | Relative Dielectric Constant |
|---|---|---|
| Example 1 | 53% | 9.5 |
| Comparative Example | 57% | 19 |

Example 1 and the comparative example show substantially equal reflectance, but the relative dielectric constant of Example 1 is smaller and greatly different from that of the comparative example. As the content of the titania-coated mica is increased, the reflectance increases. Taking it into consideration that the relative dielectric constant of the low-melting-point glass frit is 9.2, the mixing of titania-coated mica as the filler causes the relative dielectric constant to increase a little in Example 1, while the mixing of the titania filler in the comparative example causes it to double or more. Further, the observation of a sectional shape of Example 1 with an SEM confirmed that a major face of the titania-coated mica was oriented almost in parallel with the surface of the dielectric layer. As described above, the dispersion of the titania-coated mica fine powder in the low-melting-point glass in the orientation shown in FIG. 4 allows the formation of the dielectric layer having a high reflectance and a low dielectric constant.

EXAMPLE 2

The titania-coated mica was dispersed in a system (made by Catalysts & Chemicals Industory Co., Ltd.) in which silica sol having a particle diameter of 45 nm was dispersed in an organic solvent [MIBK: methylisobutylketone] and siloxane oligomer as the colloidal silica material, to give coating liquids 1 and 2. Their compositions (ratios by weight) were:

| | | |
|---|---|---|
| Coating liquid 1: | siloxane oligomer | 7 |
| | silica sol | 63 + MIBK |
| | Titania-coated mica | 30 |
| Coating liquid 2: | siloxane oligomer | 8.5 |
| | silica sol | 76.5 + MIBK |
| | Titania-coated mica | 15 |

A roll coater was used for coating. However, other common liquid coating apparatus such as a spin coater, a slit coater and a dip coater may also be used. After coating, drying and burning were performed to give dielectric layers of 7.5 μm thickness. Their reflectance and relative dielectric constant are shown in Table 3. The reflectance of a comparative example here is obtained by conversion from the reflectance of the comparative example used in Example 1 to that of a layer of 7.5 μm thickness. Since the system of siloxane oligomer and silica sol turns into a porous silica film through burning, its relative dielectric constant becomes smaller than that (4.0) of bulk silica. As described above, the use of colloidal silica and titania-coated mica allows the formation of the dielectric layer having a high reflectance and a low dielectric constant.

TABLE 3

| | Refractive Index (550 nm) | Relative Dielectric Constant |
|---|---|---|
| Coating liquid 1 | 69% | 6 |
| Coating liquid 2 | 65% | 5 |
| Comparative Example | 52% | 19 |

EXAMPLE 3

The low-melting-point glass frit and titania-coated mica (Iriodin 111) used in Example 1 were weighted in 70:30. These were dispersed in a ratio of 60:40 in a vehicle in which ethyl cellulose was dissolved in a mixed solvent of terpineol and butyl carbitol acetate, to give a paste. The paste was printed on a glass substrate on which address electrodes had been formed, followed by drying and burning. Thereby formed was an electrode protecting layer of 5 μm. Next, a paste (made by Nippon Electric Glass Co., Ltd.) for barrier ribs was applied with use of a bar coater, followed by drying. A dry film was put thereon and made into a mask by photolithography. The barrier ribs were formed by sandblasting. A paste obtained by dispersing the above low-melting-point glass frit (B16295) and titania-coated mica weighted in 40:60 in the vehicle in a ratio of 10:90 was filled in gaps between the barrier ribs, followed by drying. By burning the paste, produced was a substrate structure on the rear side having a reflective layer covering the sidewalls of the barrier ribs and the gaps between the barrier ribs.

EXAMPLE 4

This is an example of suppressing the diffusion of titania during burning. A low-melting-point glass frit (made by Central Glass Co., Ltd., product number: B9004), a titania-coated mica (Iriodin 111, made by Merk KGaA) and a titania powder ($TiO_2$P25, made by Nippon Aerosil Co., Ltd.) were weighed in a ratio of 65:30:5 and dispersed with use of a triple roll mill in a vehicle in which ethyl cellulose was dissolved in 5 wt % in a mixed solvent of terpineol and butyl carbitol acetate, to give a paste. On the other hand, as a comparative example, the above-mentioned low-melting-point glass frit and the titania-coated mica were weighed in a ratio of 70:30 and dispersed in the same manner as described above, to give a paste. These pastes were applied to transparent substrates by screen printing, followed by drying and then burning, to form dielectric layers. The burning temperature was varied as a parameter, and a change in the reflectance was measured. Table 4 shows the thickness of the burned films and the dependence on the reflectance upon the burning temperature.

TABLE 4

| Burning | Examples | | Comparative Examples | |
|---|---|---|---|---|
| Temperature (° C.) | Thickness of Film (μm) | Refractive Index | Thickness of Film (μm) | Refractive Index |
| 620 | 7.71 | 47.0 | 7.03 | 40.8 |
| 630 | 8.02 | 44.0 | 7.70 | 37.0 |
| 640 | 7.08 | 41.7 | 7.78 | 30.5 |

As the burning temperature rises, the reflectance decreases in all cases, but it drops more largely with the comparative examples than with the examples. That is, the addition of the titania suppresses the diffusion of titania from the titania-coated mica and reduces a drop in the reflectance. However, since screen printing was used as a coating method in the examples and comparative examples, the orientation was not sufficient and the reflectance itself was a little smaller than in the case where a roll coater is used.

EXAMPLE 5

A low-melting-point glass frit (made by Central Glass Co., Ltd., product number : B9004), a titania-coated mica (Iriodin 111, made by Merk KGaA) and a titania powder ($TiO_2$P25, made by Nippon Aerosil Co., Ltd.) were weighed in a ratio of 65:30:5 and dispersed in a vehicle in which an acrylic resin (BR-102, made by Mitsubishi Rayon Co., Ltd.) was dissolved in 20 wt % in a mixed solvent of 99 wt % toluene and 1 wt % dibutylphthalate, to give a slurry. The slurry was formed to a thickness of 50 μm with use of a reverse coater, to give a resin sheet containing the titania-coated mica. The resin sheet was put on a glass substrate on which barrier ribs and address electrodes had been formed beforehand and contacted closely to the barrier ribs and the address electrodes using a vacuum laminator. Thereafter, the resin sheet was burned at 550° C. in atmosphere.

As a comparative example, a low-melting-point glass frit (made by Central Glass Co., Ltd., product number : B9004), a titania-coated mica (Iriodin 111, made by Merk KGaA) and a titania powder ($TiO_2$P25, made by Nippon Aerosil Co., Ltd.) were weighed in a ratio of 65:30:5 and dispersed with use of a triple roll mill in a vehicle in which ethyl cellulose was dissolved in 5 wt % in a mixed solvent of terpineol and butyl carbitol acetate, to give a paste. This paste was applied to a glass substrate on which the barrier ribs and the address electrodes had been formed beforehand, followed by drying and burning, to form a reflective film. The reflective layer formed with the paste was inferior to the reflective film formed with the resin sheet both in uniformity in cells and the orientation of the mica.

EXAMPLE 6

This example is an example in which black barrier ribs are combined with a reflective layer. A low-melting-point glass frit (made by Nippon Electric Glass Co., Ltd.), a titania-coated mica (Iriodin 111, made by Merk KGaA) were weighed in a ratio of 70:30 and dispersed in a vehicle in which an acrylic resin (BR-102, made by Mitsubishi Rayon Co., Ltd.) was dissolved in 20 wt % in a mixed solvent of 99 wt % of toluene and 1 wt % of dibutylphthalate, to give a slurry. The slurry was formed to a thickness of about 30 μm with use of a reverse coater, to give a resin sheet containing the titania-coated mica.

Separately, an electrode protecting layer of 5 μm was formed on a glass substrate on which address electrodes had been formed, using the same material and method as described in Example 3. Further, a paste for black barrier ribs was prepared for producing black barrier ribs. The paste for black barrier ribs was obtained by adding a black pigment to the paste (made by Nippon Electric Glass Co., Ltd.) for barrier ribs used in Example 3 in a proportion of 3 to 80 parts by weight to 100 parts by weight of the low-melting-point glass frit. As the black pigment, may be used a metal oxide containing one kind or two or more kinds of oxides of Fe, Cr, Mn and Co as a main ingredient.

The paste for black barrier ribs was applied with use of a bar coater to the above-described glass substrate on which the electrode protecting layer had been formed, followed by drying. A dry film was put thereon, a mask pattern was formed by photolithography, and the black barrier ribs were formed by sandblasting in which cutting was performed by spraying blast particles.

On the substrate on the rear side on which the address electrodes, the electrode protecting layer and the black barrier ribs were thus formed, the above-described resin sheet was put by a laminate method and further the resin sheet was pressed into grooves between the barrier ribs using a silicone buffer which was easy to deform, thereby contacting the resin sheet closely to the surface of the substrate. The resin sheet adhering to top portions of the barrier ribs was removed with use of an adhesive roller to expose the top portions of the barrier ribs. In this state, performed was burning at 500° C. for 30 minutes to turn the resin sheet into a highly reflective layer. The resin sheet on the top portions of the barrier ribs may be removed by polishing after the resin sheet turns into the reflective layer through burning.

Preferably, the black barrier ribs have a transmissivity of 10%/10 μm or less to visible light. Also preferably, the highly reflective layer has a reflectance of 50%/10 μm or more.

Fluorescent layers were formed by screen printing on the substrate on which the reflective layer had been formed, an thereby a substrate on the rear side was obtained. On this substrate on the rear side, a substrate on the front side was put in an opposed relation and bonded. Then sealing and gas feeding was carried out to obtain a plasma display panel.

In the case where the barrier ribs are black and the highly reflective layer containing the titania-coated mica is formed thereon, the black barrier ribs absorb external light incident into the panel, and also in cells the highly reflective layer effectively reflects fluorescence radiated by fluorescent substances so that the fluorescence is taken to the front side. Therefore, both a bright room contrast ratio and the luminance can be improved.

In this example, the electrode protecting layer was formed on the glass substrate on which the address electrodes had been formed, and the black barrier ribs were formed. However, as shown in FIG. 6, the black barrier ribs may be formed directly on the glass substrate on which the address electrodes are formed without forming the electrode protecting layer.

Comparative Example 1(Black Barrier Rib Structure)

Address electrodes, an electrode protecting layer and black barrier ribs were formed on a glass substrate using the same materials and method as used in Example 6. Without forming a reflective layer, fluorescent layers were formed. A substrate on the rear side was thus formed. To this substrate, a substrate on the front side was attached opposedly in the same manner as in Example 6, followed by sealing and gas feeding, thereby to produce a plasma display panel.

Comparative Example 2(White Highly Reflective Barrier Rib Structure)

Address electrodes, an electrode protecting layer and black barrier ribs were formed on a glass substrate using the same material and method as used in Example 3. A highly reflective layer was formed using the same material and method as in Example 6, and fluorescent layers were formed. A substrate on the rear side was thus formed. To this substrate, a substrate on the front side was attached opposedly in the same manner as in Example 6, followed by sealing and gas feeding, thereby to produce a plasma display panel.

The luminance and the bright room contrast ratio of these panels were compared and results shown in Tables 5 and 6 were obtained. The pitch of the barrier ribs was 0.39 mm in Table 5, and 1.08 mm in Table 6.

TABLE 5

| | Luminance Ratio |
|---|---|
| Example 6 | 1.8 |
| Comparative Example 1 | 1 |
| Comparative Example 2 | 1.8 |

TABLE 6

| | Bright Room Contrast Ratio |
|---|---|
| Example 6 | 20:1 |
| Comparative Example 1 | 12:1 |
| Comparative Example 2 | 14:1 |

The bright room contrast ratio was measured under the conditions of external light: 300 1× and display luminance: 350 cd/m$^2$.

From the above results, it is found that the combination of the black barrier ribs and the reflective layer is effective for improvement of both the bright room contrast ratio and the luminance.

As described above, according to the present invention, the luminous efficiency of the plasma display panel can be improved.

More particularly, in the case where the dielectric layer is formed of a mixture of a glass base and a filler having a smaller relative dielectric constant than the glass base, the floating capacity between electrodes can be reduced. Thereby, power consumption owing to the floating capacity between electrodes can be reduced and the luminous efficiency can be improved.

Also in the case where the filler dispersed in the dielectric layer is formed in flakes whose front and back surfaces are oriented in a direction along the surface of the dielectric layer, the reflectance of the dielectric layer functioning as a reflective layer for enhancing the luminance can be increased and thereby the luminous efficiency can be improved.

Further, in the case where the barrier ribs are black and the sidewalls of the barrier ribs are covered with the dielectric layer in which the filler is dispersed, both the bright room contrast ratio and the luminance can be improved by the combination of the black barrier ribs and the highly reflective layer.

What is claimed is:

1. A plasma display panel comprising:

a dielectric layer in which a filler for enhancing reflectance is dispersed; and barrier ribs for partitioning a discharge space, wherein sidewalls of the barrier ribs are covered with the dielectric layer, wherein the filler comprises pieces individually having outward appearance of flakes whose front and back faces are oriented in a direction along a surface of the dielectric layer, and the dielectric layer is formed using a hollow form provided with recesses in a pattern corresponding to the form of the barrier ribs and has a dielectric constant $\leqq 10$.

wherein the filler is mica coated with titanium dioxide.

2. A plasma display panel according to claim 1, wherein the dielectric layer contains a low-melting-point glass as a base material.

3. A plasma display panel according to claim 2, wherein the content of the filler in the dielectric layer is a value within the range of 10 to 80 wt %.

4. A plasma display panel according to claim 1, wherein the dielectric layer contains silicon oxide as a base material.

5. A plasma display panel according to claim 4, wherein the content of the filler in the dielectric layer is a value within the range of 10 to 80 wt %.

6. A plasma display panel according to claim 1, wherein the barrier ribs are black.

7. A plasma display panel according to claim 6, wherein the black barrier ribs have a transmission per unit length of 10%/10 $\mu$m or less to visible light.

8. A plasma display panel according to claim 6, wherein the dielectric layer has a reflectance per unit length of 50%/10 $\mu$m or more.

9. A substrate structure to be used for fabrication of a plasma display panel as set forth in claim 1, which is provided with the barrier ribs and the dielectric layer.

10. A substrate structure according to claim 9, wherein the barrier ribs are black.

11. A plasma display panel according to claim 1, wherein a light-shielding layer is provided on a front side with respect to a discharge space and the dielectric layer is provided on a rear side with respect to the light-shielding layer.

12. A substrate structure to be used for fabrication of a plasma display panel as set forth in claim 11, wherein the light-shielding layer and the dielectric layer are provided on a substrate.

* * * * *